US006715702B2

(12) United States Patent
McPherson et al.

(10) Patent No.: US 6,715,702 B2
(45) Date of Patent: Apr. 6, 2004

(54) DUST COLLECTOR FOR POWDERED MATERIAL SPREADER

(76) Inventors: Mike McPherson, 219 Washington, Mt. Carmel, IL (US) 62863; Deryl Beakley, 3212 Channing La., Bedford, TX (US) 76021

( * ) Notice: Subject to any disclaimer, the term of this patent is extended or adjusted under 35 U.S.C. 154(b) by 33 days.

(21) Appl. No.: 10/218,964

(22) Filed: Aug. 14, 2002

(65) Prior Publication Data

US 2004/0031865 A1 Feb. 19, 2004

(51) Int. Cl.[7] ..... A01C 15/00
(52) U.S. Cl. ..... 239/663; 55/385.3
(58) Field of Search ..... 239/663, 105, 239/172, 650; 55/356, 385.3, 385.1, 341.1

(56) References Cited

U.S. PATENT DOCUMENTS

| | | | | | |
|---|---|---|---|---|---|
| 3,630,005 | A | * | 12/1971 | Reinauer | 55/302 |
| 3,856,488 | A | * | 12/1974 | Kato et al. | 55/300 |
| 4,032,074 | A | | 6/1977 | Amerine | |
| 4,061,221 | A | | 12/1977 | Higashinaka et al. | |
| 4,357,730 | A | * | 11/1982 | Lex | 15/344 |
| 4,619,052 | A | * | 10/1986 | Osburn et al. | 34/368 |
| 4,757,918 | A | | 7/1988 | Ottewell | |
| 4,767,062 | A | * | 8/1988 | Fletcher | 239/655 |
| 4,823,712 | A | * | 4/1989 | Wormer | 110/245 |
| 4,969,494 | A | | 11/1990 | Chefson | |
| 4,990,025 | A | | 2/1991 | Young et al. | |
| 5,378,079 | A | * | 1/1995 | Omann | 404/75 |
| 5,407,299 | A | * | 4/1995 | Sutton | 404/75 |
| 5,518,343 | A | | 5/1996 | Howell | |
| 5,810,475 | A | | 9/1998 | St. Ama | |
| 5,950,934 | A | | 9/1999 | Podesta et al. | |
| 6,065,922 | A | | 5/2000 | Kato et al. | |
| 6,419,418 | B1 | * | 7/2002 | Smith | 404/101 |

FOREIGN PATENT DOCUMENTS

| | | | |
|---|---|---|---|
| JP | 408005099 A | * | 1/1996 |
| JP | 02001246285 A | * | 9/2001 |

* cited by examiner

*Primary Examiner*—William E. Tapoloai
*Assistant Examiner*—Mohammad M. Ali
(74) *Attorney, Agent, or Firm*—Gerald Crutsinger

(57) ABSTRACT

A spreader truck having a vessel for storage of a volume of powdered material is disclosed. A dust collector is mounted on the spreader truck such that airborne particles are collected as particulate material is spread over a subgrade or roadway. Filter media in the dust collector serves a dual purpose of collecting dust through a vent opening when the vessel is being loaded and collecting dust adjacent the outlet opening when the powder is being dispensed on to a subgrade

14 Claims, 4 Drawing Sheets

DUST COLLECTOR FOR POWDERED MATERIAL SPREADER

TECHNICAL FIELD

A spreader for powdered particulate material including filter media mounted on a vehicle such that it serves a dual purpose of collecting particulate material through a vent opening when a vessel is being loaded and collecting dust adjacent an outlet opening when the powder is being dispensed.

BACKGROUND OF INVENTION

Using soil stabilization techniques, problem soil can be turned into a solid working surface, such as a lime stabilized road, in just a matter of hours by applying an additive which is right for specific needs and environmental considerations. Soil stabilization techniques are used for repairing road surfaces, airports, parking lots and runways and for numerous private industries.

Soil stabilization is accomplished by introducing materials such as lime, fly ash, cement or bentonite into the problem soil. Undercutting and/or backfilling the subgrade can be very time consuming and expensive. Stabilization can turn the subgrade into a working platform in a fraction of the time at reduced expense.

When soil stabilization techniques are used, projects are not delayed by wet conditions. Soil is dried and a working platform is created. Pumpy soils are bridged allowing you to pass proof roll tests. Lower maintenance costs of finished product. Increased soil strength which increases structural value of pavement and often decreases the amount of aggregate base needed. And the best part is less down time for the project, significant cost savings and ultimately higher profit. Depending on the additive which is right for specific needs and environmental considerations, the additive is loaded in a spreader and distributed to the working area in the method required. Materials must then be properly mixed with the soil at the given spread rate by dry or slurry methods with the appropriate addition of water.

The subgrade and additive are then compacted in preparation for shaping and grading. The soil is now workable for shaping and grading.

Using other conventional methods, this stage could take days or even weeks in the event of inclement weather. The final step in the stabilization is sealing of the stabilized soil in order to prevent the possibility of penetration by rain. An oil cure is necessary for soil cement. The results are obvious.

Lime, fly ash, cement, bentonite and other additives used for stabilization of problem soil, are often powder which forms a cloud of dust when it is spread. Lime, some times called quicklime, is any of various forms of calcium oxide differing chiefly in water content and percentage of constituents such as silica, alumina, and iron. Fly ash is a fine particulate ash sent up by the combustion of a solid fuel, such as coal, and recovered as a byproduct for various commercial uses. Fly ash is very light and powdery. Bentonite is an absorbent aluminum silicate clay formed from volcanic ash and used in various adhesives, cements, and ceramic fillers.

U.S. Pat. No. 4,990,025 discloses a method and apparatus for simultaneously tilling a sufficiently deep layer of soil along a roadway or improvement site to provide a stabilized and/or sealed soil base, mixing in a sufficient amount of fly ash or other suitable binder, filler, or sealer material and also mixing in a sufficient amount of water in the form of a spray to provide a durable, reliable, stabilized and/or sealed soil base. A water manifold is mounted on the outside of a hood covering a rotary tiller which tills a thick layer of soil. A plurality of tubes extend from the water manifold through the shroud to a region above the rotary tiller, injecting a dense, uniform spray of water inside the housing, prewetting the soil base being tilled. Water is supplied by a tanker truck moving slowly alongside a tractor on which the tiller is mounted. A second manifold is mounted behind the water manifold and includes a plurality of nozzles extending through the shroud. A flexible hose conducts powdery filler or binder material from another tanker truck moving alongside the filler/stabilizer machine. The powdery filler/binder material is uniformly mixed with the prewetted soil being tilled. The dense spray of water both prewets the soil being tilled and prevents powder filler, binder, or sealer material from spreading outside the hood and causing dust/particulate pollution.

U.S. Pat. No. 4,032,074 discloses a fertilizer spreader with a curved shroud to control material being spread.

U.S. Pat. No. 4,061,221 discloses a dust controlling loading chute apparatus for particulate material. The apparatus includes a flared hood having a flexible lower skirt connected to a support ring. Dust particles swirling under the hood and skirt are drawn up through the annular space between the inner and outer pipes to a collector.

U.S. Pat. No. 4,757,918 discloses a vehicle mounted spreader.

U.S. Pat. No. 4, 969,494 discloses a filtering device for filtering a moving gaseous atmosphere in an installation for unloading pulverulent product. A supply sleeve is connected between the base of a silo and the circular filing orifice of a mobile container.

U.S. Pat. No. 5,518,343 discloses a dust-free powder substance delivery and filter system for use in delivering powder material. Powder entrained in an air stream is separated from the air and filtered air is exhausted.

U.S. Pat. No. 6,065,922 discloses a powder loading device with dust containment system which includes a cover for a powder loading device which prevents the escape of loose powder when the powder is transferred from a storage container to a receiving container.

A long felt need exists for a spreader vehicle equipped with apparatus including filter media mounted on a vehicle such that it serves a dual purpose of collecting particulate material through a vent opening when a vessel is being loaded and collecting dust adjacent an outlet opening when the powder is being dispensed.

SUMMARY OF INVENTION

A spreader truck for spreading particulate material, such as lime, fly ash, cement or bentonite onto a subgrade, roadway or other surface, has a vessel for storage of a volume of powdered material and has a discharge opening. A dispenser, mounted adjacent the discharge opening, has an elongated hopper configured for discharging powdered or particulate material over substantially its entire length onto the subgrade, roadway or other surface. A dust collector, mounted above a hopper on the truck, contains a filter media, and a blower is mounted for drawing air through the filter media.

The vessel on the truck has a vent opening and the dust collector has a vent hose communicating with the vent opening, such that the blower draws dust and contaminated air from the vessel through the filter media.

A dust collector hood is mounted for receiving dust formed when powdered material is discharged from the dispenser. The dust collector hood is connected through one or more tubes communicating with the inside of the dust collector hood and the dust collector, the blower being mounted for drawing air from the dust collector hood through the filter media.

The spreader truck is preferable equipped with a source of pressurized air connected through a valve to one or more blow pipes, having at least one opening positioned for delivering air through the filter media for removing dust from the filter media which falls down into the hopper below the filter media.

BRIEF DESCRIPTION OF THE DRAWINGS

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
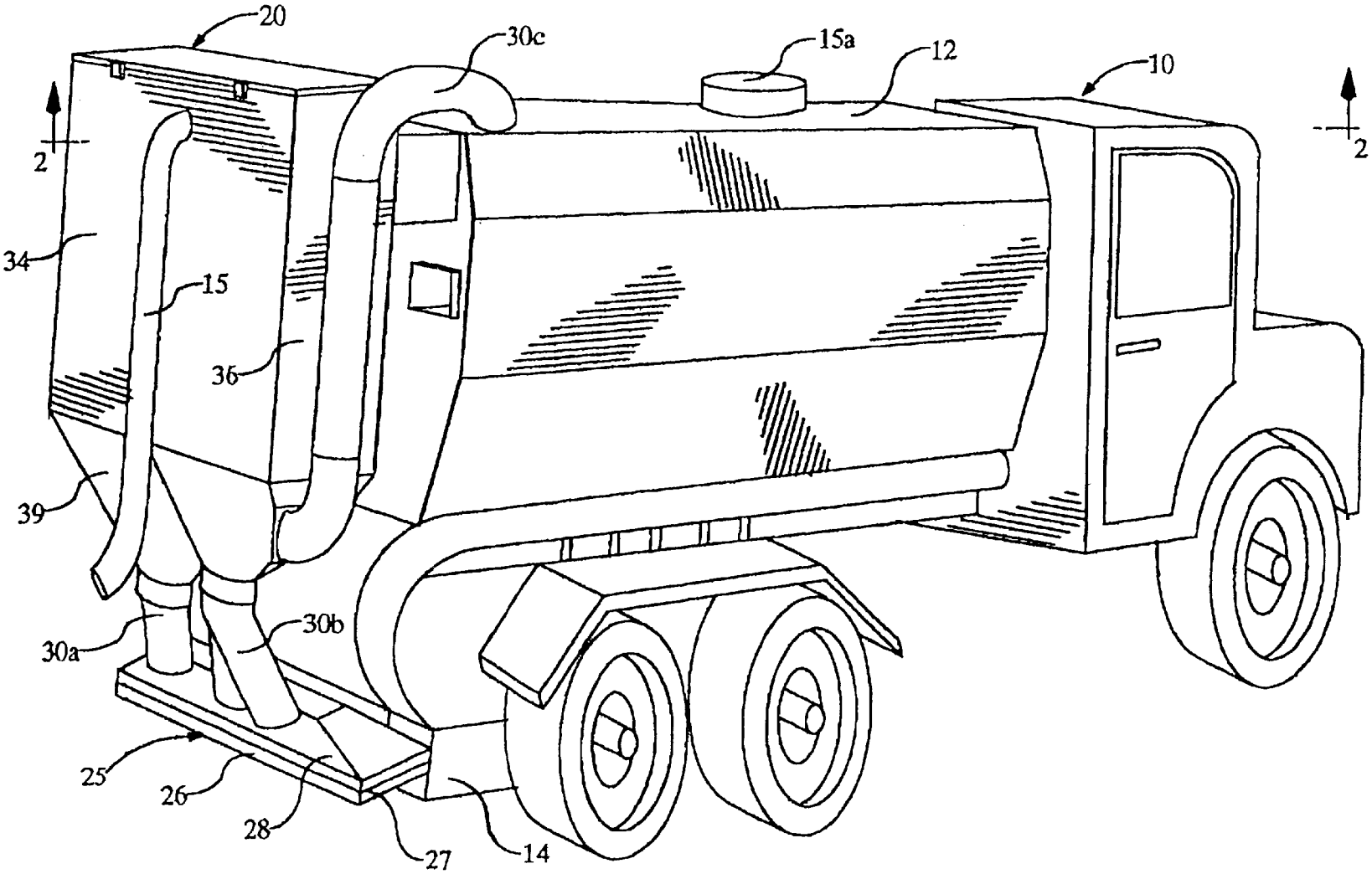
FIG. 1 is a perspective view of a dust collector mounted on a powdered material spreader.

In FIG. 1, the numeral 10 generally designates a spreader truck having a powder storage vessel 12 mounted adjacent a dispenser 14 for dispensing powdered material such as cement, fly ash, lime, bentonite and other soil additives.

Figure 2:
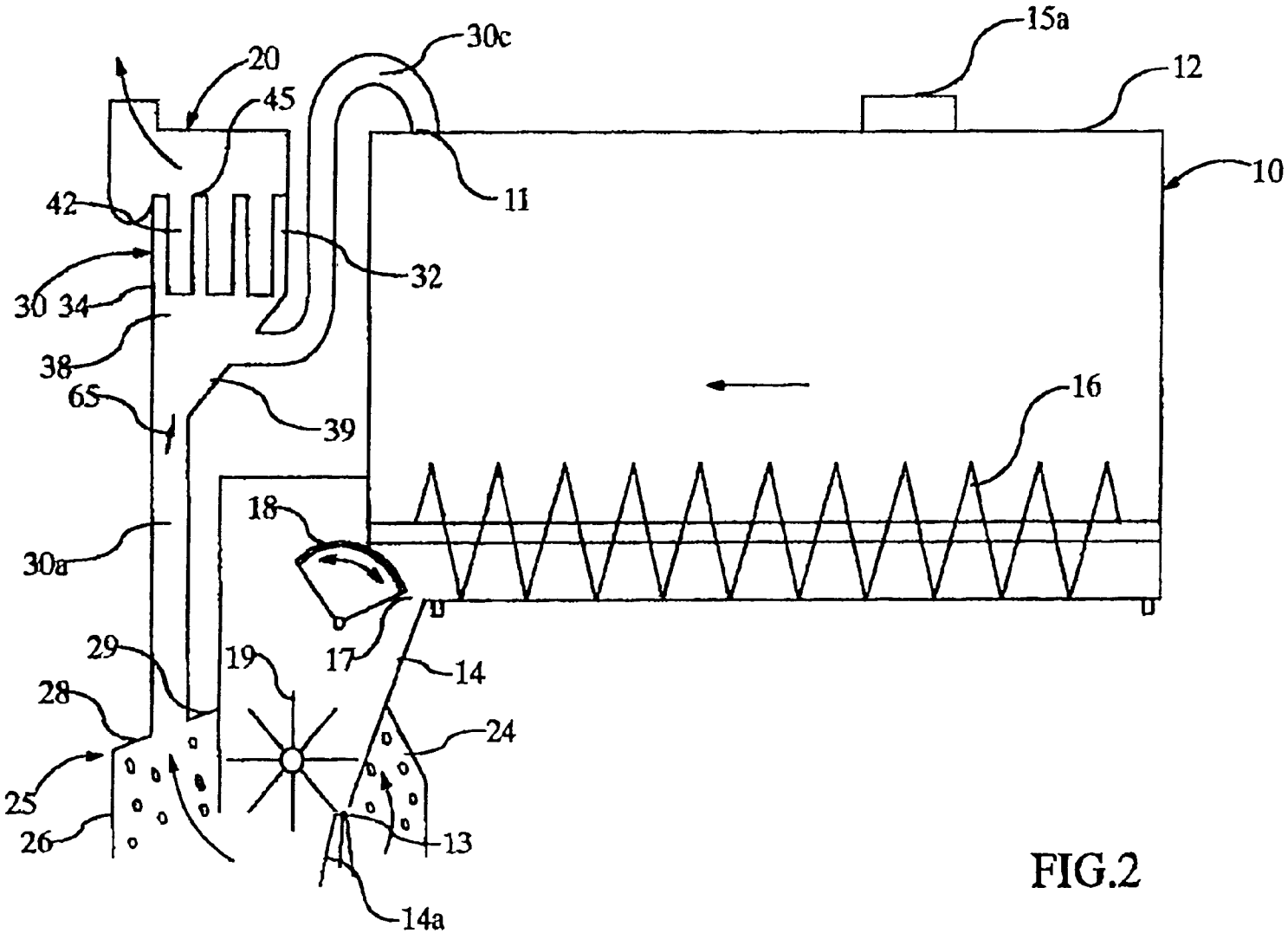
FIG. 2 is a cross sectional view taken along line 2—2 of FIG. 1.

Referring to FIG. 2 of the drawing, vessel 12 has an auger conveyor 16 in a lower portion thereof for moving powdered material through an opening 17. A gate valve 18 is mounted for movement across opening 17 for controlling the rate at which material is dispensed into dispenser 14.

Vessel 12 is filled by using pumps or blowers for delivering powder through a fill pipe or tube 15 in a manner well known to persons skilled in the art.

Powdered material flowing through discharge opening 17 is deposited on a rotating brush or roller 19 which distributes powdered material 14a across dispenser 14 for delivering powdered material at a substantially uniform rate along discharge opening 13 in the bottom of dispenser 14.

Gate valve 18 and distributor brush 19 are well known to persons skilled in the art and further description is not deemed necessary.

Vessel 12 has a vent opening 11 formed therein through which air in vessel 12 is exhausted while vessel 12 is being filled or loaded with powdered material, as will be hereinafter more fully explained.

Referring again to FIGS. 1 and 2 of the drawing, a dust collector, generally designated by the numeral 20 is mounted on spreader truck 10 and includes a hood 25 having a front wall 24, rear wall 26, side walls 27 and a top wall 28. As best illustrated in FIG. 2 of the drawing, top wall 28 has an opening 29 form therein through which dispenser 14 extends such that powdered material is dispensed between front wall 24, and rear wall 26, and spaced side walls 27.

A silo collector 30, illustrated in FIGS. 3–6 of the drawings, includes a housing having a front wall 32, rear wall 34, side walls 36 and 38 and inclined bottom walls 39 configured to form a housing assembly having a pair of hoppers in the lower end thereof with openings communicating with flexible hoses 30*a* and 30*b* which extend through spaced openings in the upper surface 28 of hood assembly 25.

A vent hose 30*c* has one end connected to vessel 12 and communicating with vent opening 11 formed in vessel 12. The other end of vent hose 30*c* extends through an opening in bottom wall 39 of the silo collector housing 30.

A plurality of filter cartridges 42 extend downwardly from a plate 45. Plate 45 is mounted between front and rear walls 32 and 34 and side walls 36 and 38 of housing 30 for forming a lower chamber 45*a* and an upper chamber 45*b* which are in fluid communication through filter cartridges 42.

Figure 6:
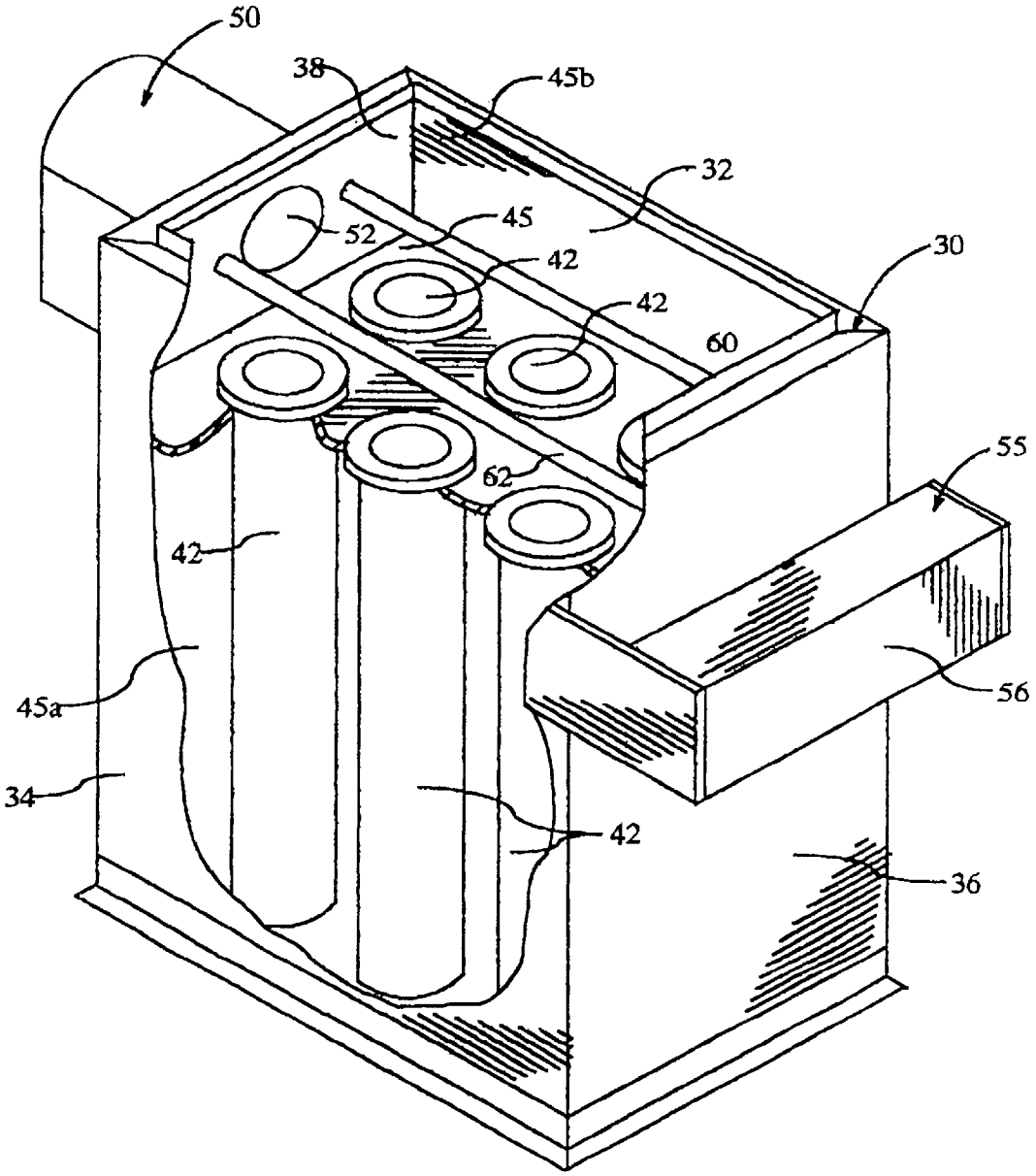
FIG. 6 is a fragmentary elevational view, parts being broken away to more clearly illustrate details of construction of dust collector cartridges.

A silo dust collector similar to that illustrated in FIG. 6 of the drawing is commercially available from C&W Manufacturing and Sales Company of Alvarado, Texas as a "Cartridge Pulse (CP) Silo Collector." The "Pulse Jet-Cartridge Silo Collectors" use a brief burst of high-pressured air to clean cartridges 42 which function as the filter media cartridges for the collectors. Cages (not shown) inside the cartridges prevent the cartridges from collapsing while dust is being collected on the outside of the cartridges as contaminated air passes through. The air flow is from the outside to the inside of the filter cartridges 42 from the lower chamber 45*a* to the upper chamber 45*b*.

Figures 3, 4, 5:
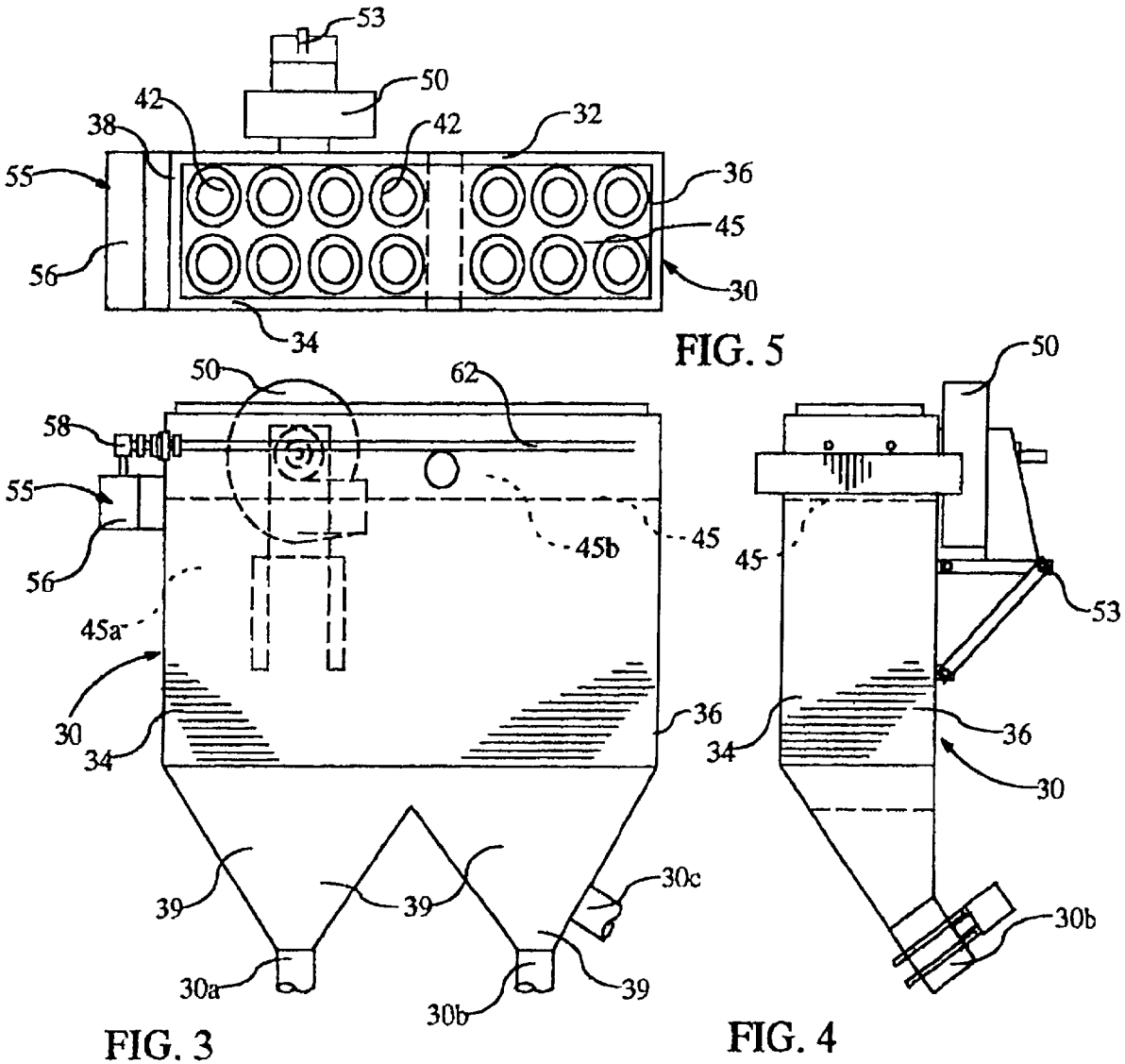
FIG. 3 is a elevational view of a dust collector.
FIG. 4 is a right side elevational view thereof.
FIG. 5 is a top plan view.

As best illustrated in FIGS. 3, 4 and 5 of the drawing, a blower 50 has a suction port which draws air from the upper chamber 45*b* and discharges clean air to atmosphere. Blower 50 is supported on a blower support assembly 53.

As best illustrated in FIGS. 3 and 6 of the drawing, a pulse jet assembly 55 includes an air tank 56 communicating through a pair of solenoid actuated valves 58 with blow pipes 60 and 62 having spaced openings formed for delivering jets of air downwardly through filter cartridges 42.

Referring to FIG. 2 of the drawing, butterfly valves 65 are mounted in the bottom of each of the hoppers formed by bottom walls 39 in the bottom of dust collector 20 and communicate with flexible tubes 30*a* and 30*b* which extend downwardly to dust collector hood 25.

From the foregoing it should be readily apparent that when blower 50 is running, a partial vacuum is formed inside collector hood 25 for drawing dust upwardly through hoses 30*a* and 30*b* into lower chamber 45*a*. The contaminated air flows through filter cartridges 42 for removing contaminants and clean air is exhausted from the upper chamber 45*b* by blower 50 to atmosphere or to any other collection chamber.

It should also be apparent that when vessel 12 is being loaded through fill pipe 15, dust and pressurized air are allowed to escape through vent opening 11 and vent hose 30*c* into the dust collector 20. The contaminated air and dust are drawn through dust cartridges 42 and clean air is exhausted to atmosphere by blower 50.

Butterfly valves 65 are adjustable to control the volume of air drawn through each of the hoses 30*a*, and 30*b*.

Air tank 56 in pulse jet system assembly 55 is maintained at a pressure of about 90 to 100 psi by an air compressor (not shown) on the truck.

When vessel 12 is being loaded, air enters the dust collector through vent hose 30*c* and the dust is collected on the outside of the filter cartridges 42. Periodically, the filter cartridges 42 need to be cleaned for removing dust from the surface thereof. When solenoid actuated valves 58 are energized, pressurized air flows from tank 56 through blow pipes 60 and 62 and out of openings formed above each filter bag 42 which sends a pulse of air down through each of the filter cartridges 42. Solenoid valves 58 are preferably timer-controlled to remove the dust from the outside of the filter cartridges.

From the forgoing, it should be apparent that the spreader truck 10, illustrated in FIG. 1, for spreading particulate material over a roadway, subgrade or other surface has a vessel 20 for storage of a volume of powdered material and has a discharge opening 17. Dispenser 14, mounted adjacent the discharge opening 17, has an elongated hopper configured for discharging powdered material over substantially its entire length onto the subgrade or other surface.

The vessel 12 on the truck 10 has a vent opening 11 and the dust collector 20 is provided with a vent hose 30*c* communicating with the vent opening 11, such that the blower 50, illustrated in FIG. 4, draws dust and contaminated air from the vessel 12 through the filter media 42 in the dust collector 20.

The dust collector hood 25 is mounted for receiving dust formed when powdered material is discharged from the dispenser 14. In a preferred embodiment, the dust collector 20 is mounted above a hopper having a plurality of inlets communicating with the inside of the dust collector hood with a butterfly valve 65 in each of the inlets for controlling air flow along the length of the dust collector hood into the dust collector.

The dust collector, communicating with the inside of the dust collector hood, contains a filter media 42 and a blower 50 is mounted for drawing air from the dust collector hood 25 through the filter media.

The spreader truck is preferable equipped with a source 56 of pressurized air connected through a valve 58 to one or more blow pipes 60 and 62, having at least one opening positioned for delivering air through the filter media 42 for removing dust from the filter media.

Terms such as "left," "right," "clockwise," "counter-clockwise," "horizontal," "vertical," "up," and "down" when used in reference to the drawings, generally refer to orientation of the parts in the illustrated embodiment and not necessarily during use. These terms used herein are meant only to refer to relative positions and/or orientations, for convenience, and are not to be understood to be in any manner otherwise limiting.

It is to be understood that while detailed description of a preferred embodiment has been illustrated and described, the invention is not to be limited to the specific arrangement of parts and specific features herein described and illustrated in the drawing. Rather, the descriptions are merely of an exemplary embodiment of the invention, which may be embodied in various forms.

Having described the invention, we claim:

1. A spreader truck for spreading particulate material over a subgrade comprising:

a vessel for storage of a volume of powdered material, said vessel having a discharge opening;

a dispenser mounted adjacent said discharge opening having an elongated hopper configured for discharging powdered material over substantially its entire length;

a dust collector hood mounted for receiving dust formed when powdered material is discharged from said dispenser;

a dust collector communicating with the inside of the dust collector hood;

filter media in said dust collector; and a blower mounted for drawing air from said dust collector hood through said filter media.

2. A spreader truck according to claim 1, said vessel for storage of a volume of powdered material having a vent opening, said dust collector having a vent hose communicating with said vent opening, such that said blower draws dust and contaminated air from said vessel through said filter media.

3. A spreader truck according to claim 1, said dust collector further comprising:

a source of pressurized air;

a blow pipe extending into said dust collector, said blow pipe having at least one opening positioned for delivering air through said filter media for removing dust from the filter media; and valve means between said source of pressurized air and said blow pipe for controlling air flow into said filter media.

4. A spreader truck according to claim 1, said dust collector being mounted above a hopper having a plurality of inlets communicating with the inside of the dust collector hood.

5. A spreader truck according to claim 4, with the addition of a valve in each of said plurality of inlets communicating with the inside of the dust collector hood for controlling air flow along the length of said dust collector hood into said dust collector.

6. A spreader truck according to claim 5, each of said valves in said plurality of inlets communicating with the inside of the dust collector hood comprising: butterfly valves.

7. A spreader truck comprising:

a vessel for storage of a volume of powdered material, said vessel having a vent opening;

a dust collector;

means for mounting said dust collector on said vessel;

a vent hose extending from said vent opening and communicating with said dust collector;

filter media in said dust collector; and a blower mounted for drawing air from said vessel through said filter media such that dust is collected on the filter media.

8. A spreader truck according to claim 7, said vessel having a discharge opening;

a dispenser mounted adjacent said discharge opening having an elongated hopper configured for discharging powdered material over substantially its entire length;

a dust collector hood mounted for receiving dust formed when powdered material is discharged from said dispenser; and a flexible tube communicating with the inside of the dust collector hood and said dust collector, said blower being mounted for drawing air from said dust collector hood through said filter media.

9. A spreader truck according to claim 8, said dust collector further comprising:

a source of pressurized air;

a blow pipe extending into said dust collector, said blow pipe having at least one opening positioned for delivering air through said filter media for removing dust from the filter media; and valve means between said source of pressurized air and said blow pipe for controlling air flow into said filter media.

10. A spreader truck comprising:

a vessel for storage of a volume of powdered material, said vessel having a vent opening and a discharge opening;

a dispenser mounted adjacent said discharge opening having an elongated hopper configured for discharging powdered material over substantially its entire length;

a dust collector hood mounted for receiving dust formed when powdered material is discharged from said dispenser;

a dust collector;

filter media in said dust collector;

a flexible tube communicating with the inside of the dust collector hood and said dust collector, said blower being mounted for drawing air from said dust collector hood through said filter media;

a vent hose extending from said vent opening and communicating with said dust collector;

means for mounting said dust collector on said vessel; and a blower mounted for drawing air from said vessel and from said dust collector hood through said filter media such that dust is collected on the filter media.

11. A spreader truck according to claim 10, said dust collector further comprising:

a source of pressurized air;

a blow pipe extending into said dust collector, said blow pipe having at least one opening positioned for delivering air through said filter media for removing dust from the filter media; and valve means between said source of pressurized air and said blow pipe for controlling air flow into said filter media.

12. A spreader truck according to claim 10, said dust collector being mounted above a hopper having a plurality of inlets communicating with the inside of the dust collector hood.

13. A spreader truck according to claim 10, with the addition of a gate valve in said dispenser mounted adjacent said discharge opening for controlling flow of powdered material into said elongated hopper.

14. A spreader truck according to claim 13, said dust collector having a plurality of inlet openings and said dust collector hood having a plurality of outlet opening; and with the addition of a valve in each of said plurality of inlet openings communicating with the inside of the dust collector hood for controlling air flow along the length of said dust collector hood into said dust collector.

* * * * *